US009067225B2

(12) United States Patent
Zhou et al.

(10) Patent No.: US 9,067,225 B2
(45) Date of Patent: Jun. 30, 2015

(54) ROTARY SWITCH VALVE AND SHOWER GROUP WITH ROTARY SWITCH VALVE

(75) Inventors: Huasong Zhou, Xiamen (CN); Tianyu Chen, Xiamen (CN); Ziguang Liu, Xiamen (CN); Qingshuang Li, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 635 days.

(21) Appl. No.: 13/390,854

(22) PCT Filed: Aug. 26, 2010

(86) PCT No.: PCT/CN2010/076385

§ 371 (c)(1),
(2), (4) Date: Feb. 16, 2012

(87) PCT Pub. No.: WO2011/023119

PCT Pub. Date: Mar. 3, 2011

(65) Prior Publication Data

US 2012/0145810 A1 Jun. 14, 2012

(30) Foreign Application Priority Data

Aug. 27, 2009 (CN) ..... 2009 1 0306217
Aug. 27, 2009 (CN) ..... 2009 2 0309053 U

(51) Int. Cl.
*A62C 31/00* (2006.01)
*B05B 1/18* (2006.01)
*B05B 1/16* (2006.01)

(52) U.S. Cl.
CPC ..... *B05B 1/18* (2013.01); *B05B 1/1645* (2013.01)

(58) Field of Classification Search
CPC ..... F16K 11/02; F16K 11/072; F16K 11/085; F16K 11/0853; B05B 15/00; B05B 1/18; B05B 1/1645
USPC ..... 239/443, 446, 447, 581.1, 581.2, 582.1; 137/625.11, 625.46, 625.47, 597; 4/567, 570, 601, 615
See application file for complete search history.

(56) References Cited

U.S. PATENT DOCUMENTS

| | | | | |
|---|---|---|---|---|
| 4,752,975 | A | 6/1988 | Yates | |
| 4,901,927 | A * | 2/1990 | Valdivia | 239/446 |
| 5,788,160 | A | 8/1998 | Woog | |
| 7,143,961 | B1 * | 12/2006 | Wu et al. | 239/446 |
| 7,299,510 | B2 * | 11/2007 | Tsai | 4/601 |

FOREIGN PATENT DOCUMENTS

| | | |
|---|---|---|
| CN | 01243954 | 2/2000 |
| CN | 2564258 | 8/2003 |

(Continued)

*Primary Examiner* — Dinh Q Nguyen
(74) *Attorney, Agent, or Firm* — Rabin & Berdo, P.C.

(57) ABSTRACT

A rotary switch valve has a main body with a division board hermetically set in a sleeve body and the sleeve body and has a water inlet and two water outlets, a let-off pipe rotationally joined to the back of the sleeve body and connected to the back cavity, and a water division plate which is rotationally set in the sleeve body to rotate between the first and second position and is fixed to the let-off pipe to rotate along the let-off pipe to connect or cut off the water outlet in the first water outlet or the second water outlet. The shower group with the rotary switch valve has an arm tube, a rain shower connected to the first water outlet and a head shower connected to the second water outlet. The head shower water outlets and the rain shower can be switched by rotating the let-off pipe.

8 Claims, 7 Drawing Sheets

(56) References Cited

FOREIGN PATENT DOCUMENTS

| | | |
|---|---|---|
| CN | 2776564 | 5/2006 |
| CN | 2865531 | 2/2007 |
| CN | 201074346 | 6/2008 |
| CN | 201180808 | 1/2009 |
| CN | 201180814 | 1/2009 |
| CN | 201197969 | 2/2009 |
| CN | 101642737 | 2/2010 |
| CN | 201493213 | 6/2010 |

* cited by examiner

ROTARY SWITCH VALVE AND SHOWER GROUP WITH ROTARY SWITCH VALVE

FIELD OF THE INVENTION

The present invention relates to a shower equipment, more particularly to a rotary switch valve and a shower group with rotary switch valve.

BACKGROUND OF THE INVENTION

For combining the function of the fixed shower and the hand-held shower at the prior art, the water outlet is connected to one end of the hose, the other end of the hose is connected to the shower, and a converter is needed, it is complicated and high-cost and turns the procedure to be cockamamie. The invention "a shower water outlet converter" (CN810007479.6) discloses a shower water outlet converter, it comprises a water inlet, two water outlet and a conversion wrench cover, a hose is connected to the first water outlet, the other end of the hose is connected to the hand-held shower, the second water outlet is connected to the fixed shower, a special wrench control converter is needed to control and switch different water outlets.

SUMMARY OF THE INVENTION

The object of the present invention is to offer a rotary switch valve, it is convenient to choose different water outlets in the shower equipment and its structure is simple.

Another object of the present invention is to offer a shower group with rotary switch valve, which overcomes the structure complexity and inconvenient to use of the shower equipment in the background of the present invention.

One of the technical proposals of the present invention is:

A Rotary switch valve, it comprises:

A main body, it comprises a sleeve body and a division board hermetically set in the sleeve body, the division board divides the sleeve body into a front cavity and a back cavity; the division board has the first water outlet that connects the front cavity with the back cavity, the sleeve body has a water inlet and the second water outlet that connect the front cavity;

A water division plate that is rotationally set in the sleeve body to rotate between the first position and the second position comprises a water division board that is back on the front of the division board hermetically, a convex block that is firmly set at the front of the water division board, a gasket that is set at the end of the side of the convex block, there is a through hole in the water division board, when the water division plate is in the first position, the through hole of the said water division board and the first water outlet of the said division board are being connected and the second water outlet is sealed by the gasket; when the water division plate is in the second position, the through hole of the said water division board and the first water outlet of the said division board are interlaced and blocked and the second water outlet is staggered with the gasket and be unobstructed;

A let-off pipe, of which the front end is fixed to the water division plate and the cavity is connected to the back cavity of the main body;

A rotational let-off pipe drives the water division plate rotate in the sleeve body, so that the water outlet's connecting and the blocking of the first water outlet and/or the second water outlet are controlled.

The said let-off pipe is L-shape pipeline which has an entry end and a effluent end, said entry end is hinged and joined after the sleeve body and connects the back cavity.

Another technical proposal of the present invention is:

A shower group with rotary switch valve, which is fixed to an arm tube, it comprises:

A main body, it comprises a sleeve body and a division board hermetically set in the sleeve body, the said division board divides the sleeve body into a front cavity and a back cavity; the said division board has the first water outlet that connects the front cavity with the back cavity, the said sleeve body has a water inlet and the second water outlet that connect the front cavity;

A let-off pipe, of which the front end is fixed to the water division plate and the cavity is connected to the back cavity of the main body;

A head shower, which is connected to the let-off pipe;

A rain shower, which is fixed to the sleeve body and connected to the second water outlet;

A water division plate that is rotationally set in the sleeve body to rotate between the first position and the second position comprises a water division board that is back on the front of the division board hermetically, a convex block that is firmly set at the front of the water division board, a gasket that is set at the end of the side of the convex block, there is a through hole in the water division board, when the water division plate is in the first position, the through hole of the said water division board and the first water outlet of the said division board are being connected and the second water outlet is sealed by the gasket; when the water division plate is in the second position, the through hole of the said water division board and the first water outlet of the said division board are interlaced and blocked and the second water outlet is staggered with the gasket and be unobstructed;

A rotational let-off pipe drives the water division plate rotate in the sleeve body, so that the water outlet's connecting and the blocking of the first water outlet and/or the second water outlet are controlled.

The said let-off pipe is L-shape pipeline which has an entry end and a effluent end, said entry end is hinged and joined after the sleeve body and connects the back cavity, the said effluent end is connected to the head shower.

A attaching groove of which opening is ahead outside along the radial direction is opened up on the said convex block, the attaching groove has a compressing spring inside, the said gasket is set in the attaching groove and is resisted by the compressing spring to extend the open of the said attaching groove.

The first water outlet of the division board is fit to the through hole of the said water division board.

It further comprises a fixed axle that can rotationally pass through the division board and fix to the let-off pipe and the water division plate.

The division board has a hinge hole whose axis coincides with the axis of the sleeve body; a shoulder hole whose outside is big and inside is small runs through the inner tube of the L-shape pipeline of the let-off pipe, the axis of the said shoulder hole coincides with the axis of the sleeve body; the fixed axle has the first end and the second end, the said second end annularly projects along the radial direction to form convex shoulder; the first end of the fixed axle pass through the shoulder hole of the water inlet pipe and the hinge hole of the division board, a screw locks and joins the water division plate and the first end of the fixed axle, the convex shoulder of the fixed axle hermetically leans and joins the stepped surface of the shoulder hole.

A limiting mechanism is set between the said sleeve body and the let-off pipe, the limiting mechanism comprises a fixed block fixed to the sleeve body and a limiting slot set at the entry end of the let-off pipe, and the limiting mechanism has the first end and the second end, said water division plate is in the first position when the fixed block is at the first end, said water division plate is in the second position when the fixed block is at the second end.

Compared with the technology in the background, the beneficial of the present invention are: 1 the first water outlet, the second water outlet and a water inlet are directly set on the main body of the rotary switch valve disclosed in the present invention, said water outlets are connected to different let-off pipe, the on and off of the first water outlet and/or the second water outlet are controlled by rotating the let-off pipe without installing control wrench, so that the structure is simply; 2 the let-off pipe and the rain shower are connected and supported by the arm tube without hose in the shower equipment of the present invention, the switch of the pipe and the rain shower are easily achieved by swinging the let-off pipe, so that the switch of the fixed shower and the hand-held shower is conveniently achieved, the users can directly hold and swing the arm tube, the actuating arm is long, and the hand effort is small and convenient, there is no need to stand on a foot pad or other high structure for the users; 3 all of the shower equipment's components are tightly fixed, well sealed and the structure is compact; 4 the fixed axle can work as fixed joint, hinge axle and locating the rotation of the axle simultaneously.

REFERENCE SIGNS

Figure 1:
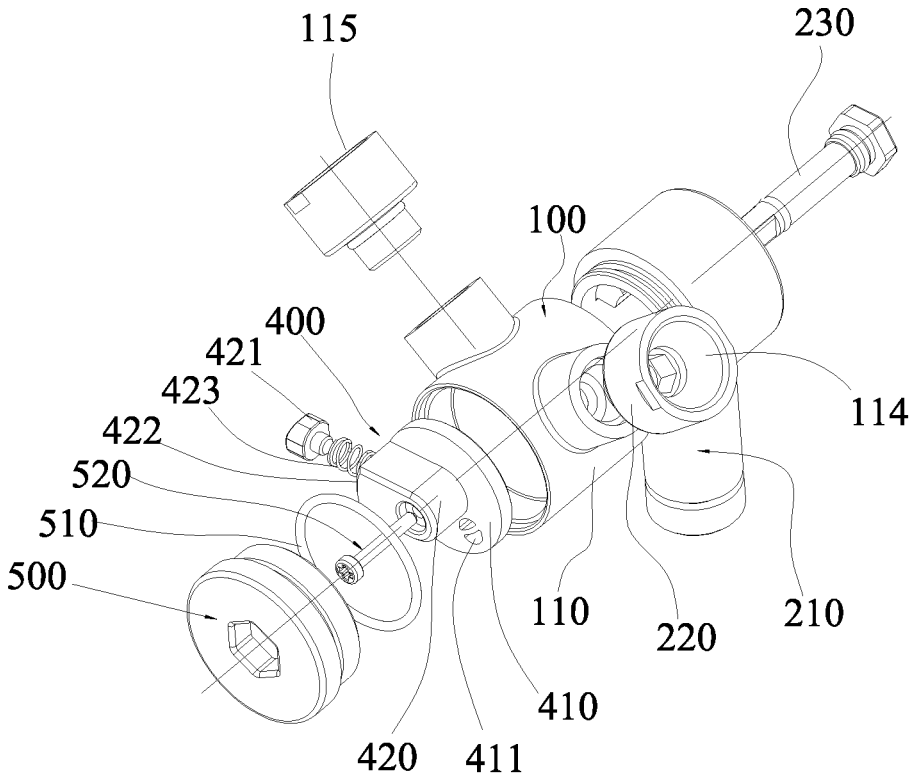
FIG. 1 shows the exploded view according to the embodiment 1 of the rotary switch valve in the present invention.

Main body—100; sleeve body—110; division board—120; front cavity—111; back cavity—112; the first water outlet—113; the second water outlet—114; water inlet—115;

L-shape pipeline—210; entry end—211; effluent end—212; shoulder hole—213; fixed axle—230; the second let-off pipe—220;

Water division plate—400; water division board —410; convex block—420; gasket—421; through hole—411; attaching groove—422; compressing spring—423;

End cap—500; washer—510; screw—520;

Limiting mechanism—700; fixed block—710; limiting slot—720; the first end—721; the second end—722;

Rotary switch valve—1; head shower—2; rain shower —3; arm tube—4; multi—heads shower—5;

DESCRIPTION OF THE PREFERRED EMBODIMENTS

With the following description of the drawings and specific embodiments, the invention shall be further described in details.

Embodiment 1, according to FIGS. 1, 2, 3, 4, 5, 6 and 7, the rotary switch valve 1 in the present invention comprises:

A main body 100, it comprises a sleeve body 110 and a division board 120 hermetically set in the sleeve body 110, the division board 120 divides the sleeve body 110 into a front cavity 111 and a back cavity 112; the division board 120 has the first water outlet 113 that connects the front cavity 111 with the back cavity 112, the sleeve body 110 has a water inlet 115 that connects the front cavity 111 and the second water outlet 114 that connects the front cavity 111; the center of the division board 120 has a hinge hole whose axis coincides with the axis of the sleeve body.

The first let-off pipe are L-shape pipeline 210 that is rotationally connected to the back cavity 112 after the sleeve body 110, the L-shape pipeline 210 has an entry end 211 and an effluent end 212, said entry end 211 is hinged and joined after the sleeve body 110 and connects the back cavity 112. A shoulder hole 213 whose outside is big and inside is small runs through the inner tube of the L-shape pipeline 210 of the let-off pipe, the axis of the shoulder hole 213 coincides with the axis of the entry end 211 (the axis of the sleeve body after assembly);

A water division plate 400 is rotationally set in the sleeve body 110 to rotate between the first position and the second position, it is fixed to the first let-off pipe and rotates along with the let-off pipe. The water division plate 400 comprises a water division board 410 that is back on the front of the division board hermetically, a convex block 420 that is firmly set at the front of the water division board 410 and a gasket 421 that is set at the end of the side of the convex block 420, there is a through hole 411 in the water division board 410, the first water outlet 113 of the division board 120 is fit to the through hole 411 of the water division board 410. A attaching groove 422 of which opening is ahead outside along the radial direction is opened up on the said convex block 420, the attaching groove 422 has a compressing spring 423 inside, the said gasket 421 is set in the attaching groove 422 and is resisted by the compressing spring 423 to extend to outside.

An end cap 500, it is sealed fixed to the front end of the sleeve body 110 through a washer 510.

A fixed axle 230, it has the first end and the second end, said second end annularly projects along the radial direction to form convex shoulder, the first end of the fixed axle hermetically passes through the shoulder hole 213 of the water inlet pipe, the hinge hole of the division board 120, and insert the water division plate 400; there is a screw 520, the helix end of said screw 520 locks and joins the water division plate 400 and the first end of the fixed axle 230, the convex shoulder of the fixed axle 230 hermetically leans and joins the stepped surface of the shoulder hole 213 with the tensile force of the said screw 520, so that the said first let-off pipe can be rotationally set in the main body 100, and the fixed connect and the synchronic rotation are form between the first let-off pipe and the water division plate 400, so that the fixed axle 230 can be hermetically and rotationally connected to the division board 120.

A limiting mechanism 700 is set between the said sleeve body 110 and the L-shape pipeline 210, the limiting mechanism 700 comprises a fixed block 710 fixed to the sleeve body 110 and a limiting slot 720 set at L-shape pipeline 210, and the limiting mechanism 720 has the first end 721 and the second end 722, said water division plate 400 is in the first position when the fixed block 710 is at the first end 721, said water division plate is in the second position when the fixed block 710 is at the second end 722.

The principles of the axial seal and the radial seal are used in the present invention to achieve the effluent switching.

Figure 2:
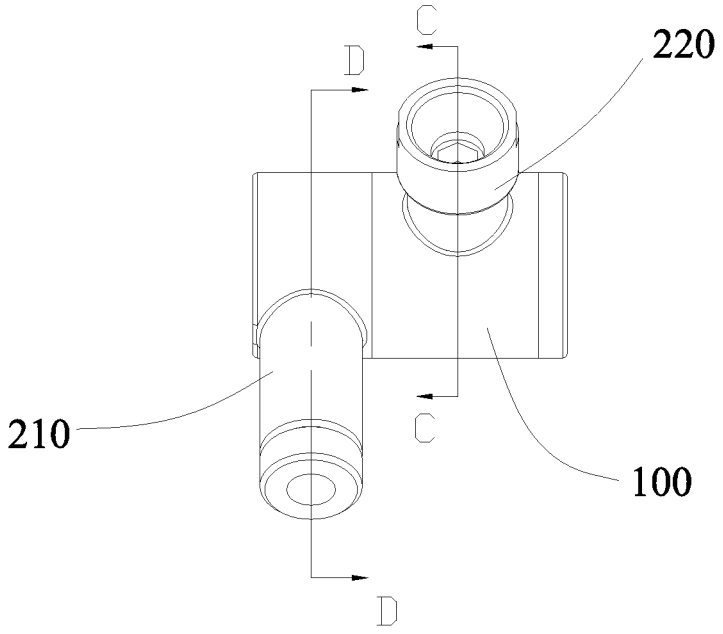
FIG. 2 shows the abridged general view according to the embodiment 1 of the present invention when the first water outlet is connected.
Figure 3:
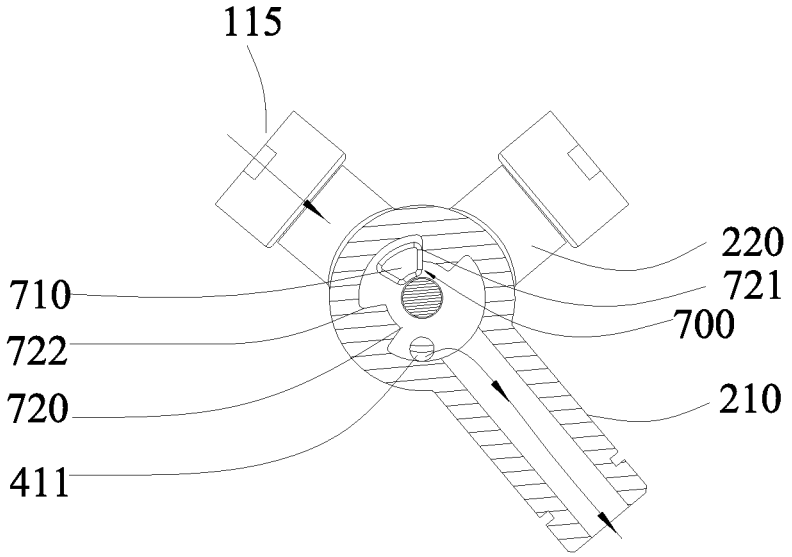
FIG. 3 shows the sectional view of the FIG. 2 along D-D.
Figure 4:
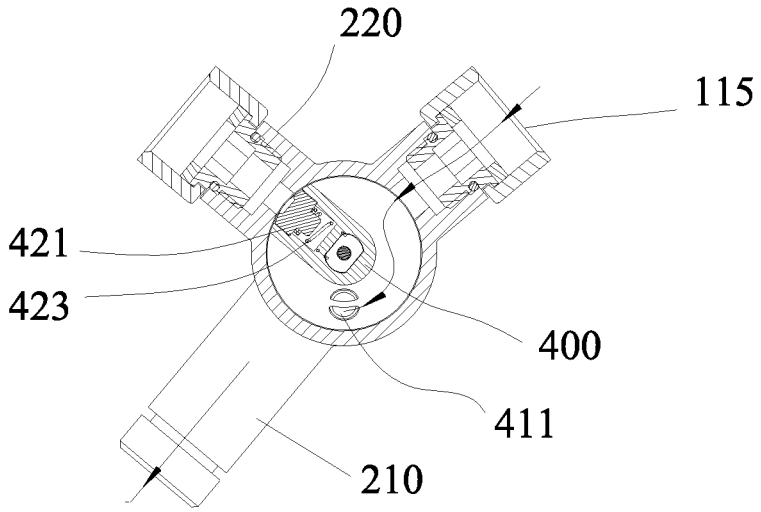
FIG. 4 shows the sectional view of the FIG. 2 along C-C.

FIGS. 2, 3 and 4 show the abridged general view according to the embodiment 1 of the present invention when the first water outlet is connected, rotating the first let-off pipe (namely the L-shape pipeline 210) makes the water division plate 400 in the first position, the through hole 411 of its water division board 410 is aligned and connected to the first water outlet 113 of the division board 120 in the main body 100, the gasket 421 on the convex block 420 of the water division plate seals the second water outlet 114. At the moment, the second water outlet 114 is blocked, the water comes out of the first water outlet 113.

Figure 5:
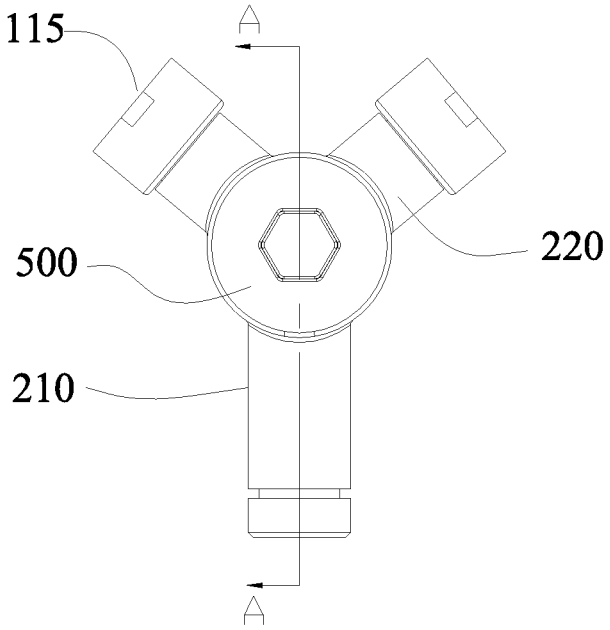
FIG. 5 shows the abridged general view according to the embodiment 1 of the present invention when the second water outlet is connected.
Figure 6:
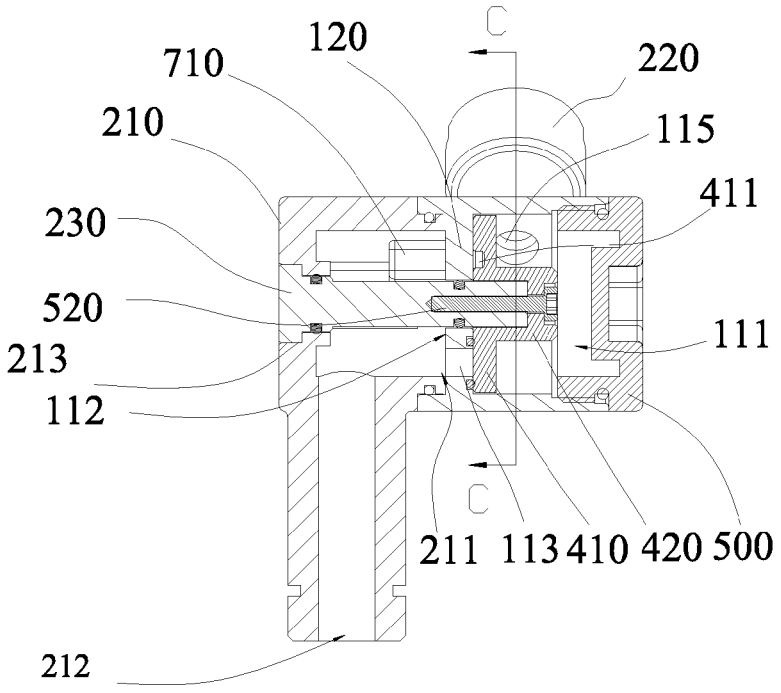
FIG. 6 shows the sectional view of the FIG. 5 along A-A.
Figure 7:
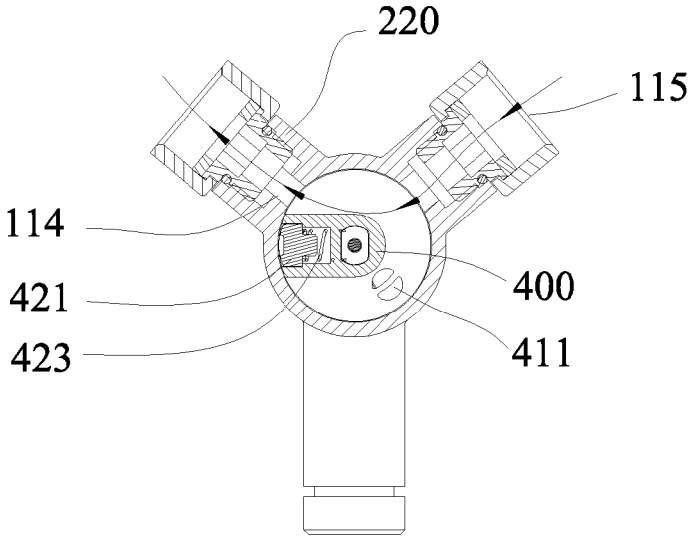
FIG. 7 shows the sectional view of the FIG. 6 along C-C.
Figure 8:
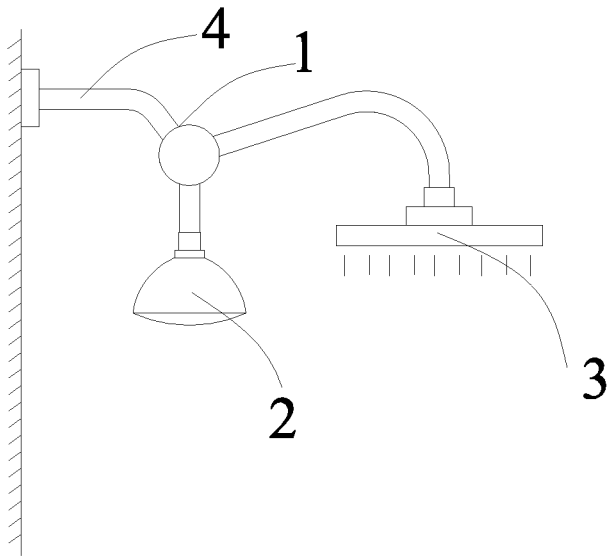
FIG. 8 shows the abridged general view according to the embodiment 2 of the shower group with rotary switch valve in the present invention; the water comes out of the rain shower.
Figure 9:
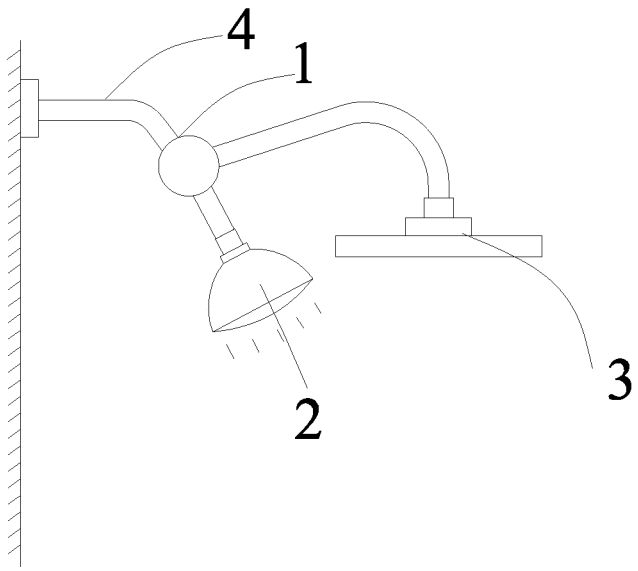
FIG. 9 shows the abridged general view according to the embodiment 2 of the shower group with rotary switch valve in the present invention; the water comes out of the head shower.

FIGS. 5, 6 and 7 show the abridged general view according to the embodiment 1 of the present invention when the second water outlet is connected, rotating the first let-off pipe (namely the L-shape pipeline 210) makes the water division plate 400 in the second position, the through hole 411 of its water division board 410 is blocked with the first water outlet 113 of the division board 120 in the main body 100, the gasket 421 on the convex block 420 of the water division plate staggers the second water outlet 114 and makes it smooth. At the moment, the first water outlet 113 is blocked, the water comes out of the first water outlet 114.

Embodiment 2, according to FIGS. 1, 2, 3, 4, 5, 6, 7, 8 and 9, A shower group with rotary switch valve comprises the rotary switch valve 1, the head shower 2, the rain shower 3 and the arm tube 4.

The structure of the rotary switch valve 1 is the same to the embodiment 1, and it is not mentioned here.

A head shower 2, which is connected to the effluent end of the rotary switch valve's first let-off pipe (L-shape pipeline), is connected to the first water outlet 113. In this embodiment, a universally regulate structure is set between the head shower 220 and the effluent end, and can be slightly adjusted universally;

A rain shower 3, which is fixed to the second let-off pipe 220 of the rotary switch valve 1 and connected to the second water outlet 114;

A arm tube 4, it is fixed to the end of the water inlet 115 of the rotary switch valve 1.

FIGS. 2, 3, 4 and 9 show the abridged general view according to the preferred embodiment of the shower group with rotary switch valve in the present invention, the first water outlet is connected at the moment. The rotational head shower 2 drives the L-shape pipeline 210 to make the water division plate 400 in the first position, the through hole 411 of its water division board 410 is aligned and connected to the first water outlet 113 of the division board 120, the gasket 421 on the convex block 420 of the water division plate seals the second water outlet 114. At the moment, the second water outlet 114 is blocked, the water comes out of the head shower 4 connected to the first water outlet 113.

FIGS. 5, 6, 7 and 8 show the abridged general view according to the preferred embodiment of the shower group with rotary switch valve in the present invention, the second water outlet is connected at the moment. The rotational head shower 2 drives the L-shape pipeline 210 to make the water division plate 400 in the second position, the through hole 411 of its water division board 410 is blocked with the first water outlet 113 of the division board 120, the gasket 421 on the convex block 420 of the water division plate staggers the second water outlet 114 and makes it smooth. At the moment, the first water outlet 113 is blocked, the water comes out of the rain shower 3 connected to the first water outlet 114.

The assemble process of the equipment in the present invention comprises: locating the water division plate in the main body; locating the let-off pipe (L-shape pipeline) and the main body; inserting the fixed axle, and making its first end inserted the water division plate through the shoulder hole and hinge hole; locking the water division plate and the fixed axle with the screw; assembling the end cap. It is easy to assembly and has high efficiency.

Figure 10:
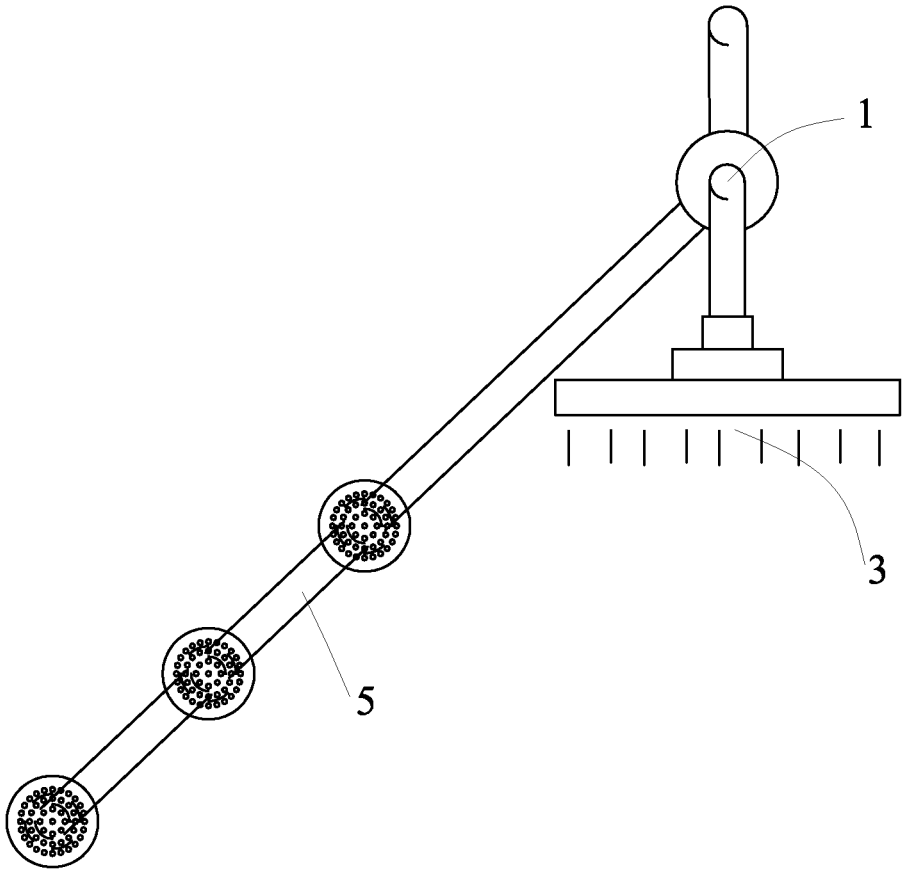
FIG. 10 shows the structure profile according to the embodiment 3 of the shower group with rotary switch valve in the present invention.
Figure 11:
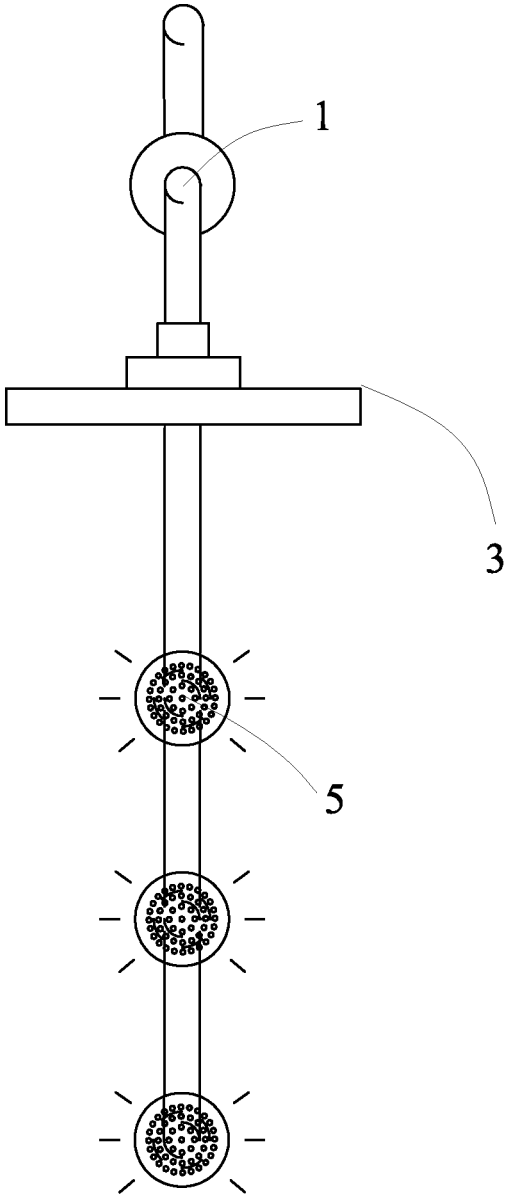
FIG. 11 shows another structure profile according to the embodiment 3 of the shower group with rotary switch valve in the present invention.

Embodiment 3 is according to the FIGS. 10 and 11.

The difference between the embodiment 3 and the previous embodiments are: there is a multi-heads shower 5 is connected to the first let-off pipe (L-shape pipeline 210) of the rotary switch valve 1 in the present invention. The effluent of the multi-heads shower 5 and/or the rain shower 3 can be controlled by rotating the rod piece of the multi-heads shower 5.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above.

INDUSTRIAL APPLICABILITY

A rotary switch valve and the shower group with the rotary switch valve in the present invention can control different effluent or shutting, its structure is simple, its conception is handiness, its effect is good, so that the present invention has good industrial applicability.

What is claimed is:

1. A shower group with rotary switch valve, which is fixed to an arm tube, wherein it comprises:

A main body, it comprises a sleeve body and a division board hermetically set in the sleeve body, the division board divides the sleeve body into a front cavity and a back cavity; the division board has a first water outlet that connects the front cavity with the back cavity, the sleeve body has a water inlet and a second water outlet that connect the front cavity;

A let-off pipe, of which a front end is fixed to a water division plate and a cavity is connected to the back cavity of the main body;

A head shower, which is connected to the let-off pipe;

A rain shower, which is fixed to the sleeve body and connected to the second water outlet;

The water division plate that is rotationally set in the sleeve body to rotate between a first position and a second position comprises a water division board that is back on the front of the division board hermetically, a convex block that is firmly set at a front of the water division board, a gasket that is set at an end of a side of the convex block, there is a through hole in the water division board, when the water division plate is in the first position, the through hole of the water division board and the first water outlet of the division board are being connected and the second water outlet is sealed by the gasket; when the water division plate is in the second position, the through hole of the water division board and the first water outlet of the division board are interlaced and blocked and the second water outlet is staggered with the gasket and be unobstructed;

A rotational let-off pipe drives the water division plate rotate in the sleeve body, so that the water outlet's connecting and the blocking of the first water outlet and/or the second water outlet are controlled.

2. The shower group with rotary switch valve according to claim 1, wherein said let-off pipe is L-shape pipeline which has an entry end and a effluent end, said entry end is hinged and joined after the sleeve body and connects the back cavity, the said effluent end is connected to the head shower.

3. The shower group with rotary switch valve according to claim 2, wherein a attaching groove which opens outside along the radial direction is set on the said convex block, the attaching groove has a compressing spring inside, the said gasket is set in the attaching groove and is resisted by the compressing spring to extend the opening of the groove.

4. The shower group with rotary switch valve according to claim 2, wherein a limiting mechanism is set between the said sleeve body and the let-off pipe, the limiting mechanism comprises a fixed block fixed to the sleeve body and a limiting slot set at the entry end of the let-off pipe, and the limiting mechanism has the first end and the second end, said water division plate is in the first position when the fixed block is at the first end, said water division plate is in the second position when the fixed block is at the second end.

5. The shower group with rotary switch valve according to claim 3, wherein the first water outlet of the division board is fit to the through hole of the said water division board.

6. The shower group with rotary switch valve according to claim 5, wherein it further comprises a fixed axle that rotatablely passes through the division board and fix to the let-off pipe and the water division plate.

7. The shower group with rotary switch valve according to claim 6, wherein the division board has a hinge hole whose axis coincides with the axis of the sleeve body; a shoulder hole whose outside is big and inside is small runs through the inner tube of the L-shape pipeline of the let-off pipe, the axis of the said shoulder hole coincides with the axis of the sleeve body; the fixed axle has the first end and the second end, the said second end annularly projects along the radial direction to form convex shoulder; the first end of the fixed axle pass through the shoulder hole of the water inlet pipe and the hinge hole of the division board, a screw locks and joins the water division plate and the first end of the fixed axle, the convex shoulder of the fixed axle hermetically leans and joins the stepped surface of the shoulder hole.

8. The shower group with rotary switch valve according to claim 1, wherein a limiting mechanism is set between the said sleeve body and the let-off pipe, the limiting mechanism comprises a fixed block fixed to the sleeve body and a limiting slot set at the entry end of the let-off pipe, and the limiting mechanism has the first end and the second end, said water division plate is in the first position when the fixed block is at the first end, said water division plate is in the second position when the fixed block is at the second end.

* * * * *